United States Patent [19]

Pennekamp

[11] Patent Number: 4,629,134

[45] Date of Patent: Dec. 16, 1986

[54] ROLL CRUSHER

[75] Inventor: Engelbert Pennekamp, Ascheberg, Fed. Rep. of Germany

[73] Assignee: Hazemag Dr. E. Andreas GmbH & Co., Münster, Fed. Rep. of Germany

[21] Appl. No.: 717,583

[22] Filed: Mar. 29, 1985

Related U.S. Application Data

[63] Continuation of Ser. No. 462,381, Jan. 31, 1983, abandoned.

[30] Foreign Application Priority Data

Feb. 2, 1982 [DE] Fed. Rep. of Germany ..... 3203328

[51] Int. Cl.[4] ..... B02L 13/20; B02L 13/26

[52] U.S. Cl. ..... 241/87.1; 241/86; 241/88; 241/89.1; 241/89.2; 241/236; 241/243; 241/285 B

[58] Field of Search ..... 241/73, 79, 84, 86, 241/87.1, 88, 89.1, 89.2, 235, 236, 242, 243, 285 A, 285 B

[56] References Cited

U.S. PATENT DOCUMENTS 3,480,214 11/1969 Wageneder ..... 241/285 A 3,703,970 11/1972 Benson ..... 241/243 X 4,002,302 1/1977 Miller ..... 241/285 B X 4,385,732 5/1983 Williams ..... 241/236

*Primary Examiner*—Howard N. Goldberg

*Assistant Examiner*—Timothy V. Eley

*Attorney, Agent, or Firm*—Peter K. Kontler

[57] ABSTRACT

A roll crusher for discarded storage batteries or other types of bulky scrap has two rotors provided with axially spaced-apart annuli of teeth which cooperate with rows of teeth provided on a grate normally adjacent to the undersides of the rotors. The grate is pivotable about an axis which is closely adjacent to, parallel with and disposed at a level below one of the rotors so that it can assume an inoperative position in which it extends substantially vertically downwardly and each of its sides is readily accessible for cleaning, replacement or inspection of its teeth. The teeth of the grate are disposed in rows and each such row of teeth is integral with a discrete plate-like carrier which is removably inserted into the frame of the grate so that it can be expelled or withdrawn if the treated material is not readily detachable from the teeth of the grate while the grate dwells in the inoperative position.

17 Claims, 4 Drawing Figures

ROLL CRUSHER

This application is a continuation of application Ser. No. 462,381 filed Jan. 31, 1983, now abandoned.

BACKGROUND OF THE INVENTION

The present invention relates to comminuting machines in general, especially to roll crushers, and more particularly to improvements in comminuting machines of the type wherein a grate is movable to and from an operative position with reference to one or more toothed or analogous rotors.

It is well known to provide the rotor of a roll crusher with annuli of circumferentially extending teeth which cooperate with the teeth of a grate to break up bulky pieces of refuse, building material or the like. In many instances, the grate surrounds the underside and a second side of the rotor and has teeth extending into the spaces between the annuli of teeth on the rotor. Movability of the grate to and from an operative position with reference to the rotor is desirable and advantageous when the machine is to comminute bulky goods containing tough and/or readily flexible constituents which are likely to cling to the grate and to thereby interfere with proper comminution of next-following materials. Moreover, the constituents of the material to be comminuted are likely to damage the teeth and/or other parts of the grate so that the accessibility of such parts is important in order to avoid prolonged down times for replacement of damaged parts.

British Pat. No. 1,366,975 discloses a crusher which is used for the treatment of garbage and employs a grate disposed at one side of the rotor. The upper end portion of the grate is pivotably mounted in the housing of the crusher so that the grate can be swung to a position in which its teeth are spaced apart from the teeth of the rotor. The angle through which the grate is pivotable between its operative and inoperative positions is relatively small so that the accessibility of the grate upon movement to inoperative position is rather limited. Therefore, the removal of parts which cling to the grate and/or the repair work upon the grate is a tedious and time-consuming operation.

The situation is analogous when the comminuting machine comprises two rotors, i.e., the grate is normally pivotable about an axis which is located at the level of the one or the other rotor so that, when the grate is moved to the inoperative position, its toothed side is not readily accessible for all kinds of inspection, repair or cleaning work. An impact crusher wherein the pivot axis for the grate is located at the general level of the axis of the rotor is disclosed, for example, in British Pat. No. 1,249,738. In the machine of this patent, the grate is pivotable by an actuator means so as to move its lower portion away from the periphery of the rotor in order to change the comminuting action.

German Auslegeschrift No. 1,211,908 discloses a safety feature involving such mounting of the grate that the latter can yield when a piece of material which cannot be comminuted advances through the housing of the machine. Again, the pivot axis for the grate is located at the general level of the rotor axis, and the extent of angular movement of the grate about such axis is relatively small so that the toothed side of the grate is not readily accessible when it is held at a maximum distance from the periphery of the rotor.

German Pat. No. 704,853 discloses a grate which is pivotable about its lower end and is movable through a relatively small angle (of 45° or less) between the operative and inoperative positions. Such pivoting of the grate is not sufficient to ensure convenient access to that side which is normally adjacent to the rotor. Similarly mounted grates are disclosed in German Pat. No. 450,481 and in U.S. Pat. No. 2,149,571.

OBJECTS AND SUMMARY OF THE INVENTION

An object of the invention is to provide a novel and improved comminuting machine, particularly a roll crusher with one or more rotors, which is constructed and assembled in such a way that the parts which are most likely to require frequent inspection are fully accessible for repair, replacement and/or cleaning.

Another object of the invention is to provide a roll crusher wherein the grate is constructed, assembled and mounted in a novel and improved way so as to afford full access to its material-contacting and comminuting components.

A further object of the invention is to provide a novel and improved mounting for the grate in the housing of a roll crusher or an analogous comminuting machine.

An additional object of the invention is to provide a roll crusher which, though highly versatile as regards the nature of materials which are to be treated thereby, is especially suited for the fragmentizing of storage batteries and/or analogous bulky commodities which do or are supposed to contain acids and/or other aggressive substances likely to attack the constituents of the grate and/or other parts of the machine.

Another object of the invention is to provide a novel and improved housing for use in a comminuting machine of the above outlined character.

Still another object of the invention is to provide a roll crusher or an analogous comminuting machine wherein the grate is more readily accessible than in heretofore known machines.

A further object of the invention is to provide a roll crusher wherein the entire grate can be readily removed from or reinstalled in the housing.

An additional object of the invention is to provide a roll crusher wherein a relatively simple, lightweight and inexpensive grate can cooperate with one or more rotors to break up extremely tough and bulky commodities, such as discarded storage batteries for automotive vehicles and the like.

A further object of the invention is to provide a novel and improved method of designing, mounting and manipulating the grate in a single-rotor or multiple-rotor roll crusher.

The invention is embodied in a comminuting machine, particularly in a roll crusher, which comprises a housing, at least one rotor mounted in the housing for rotation about a substantially horizontal axis and having several axially staggered circumferentially extending annuli of external teeth, a grate having at least one set of several rows of teeth which alternate with the annuli of teeth, as considered in the axial direction of the rotor, and mounting means provided on the housing and defining for the grate a pivot axis which is preferably at least substantially parallel to the axis of the rotor and is located at a level below the rotor so that the grate is movable about the pivot axis between a first or operative position in which its rows of teeth extend at least from below between the neighboring annuli of teeth on the rotor and a second or inoperative position in which the rows of teeth are located beneath and extend (hang) downwardly from the pivot axis. Each row of teeth has an end portion adjacent to the mounting means, i.e., the rows of teeth can be said to extend substantially radially of the mounting means.

The housing is preferably provided with an opening and with a door or other suitable means for selectively closing and exposing the opening. The latter is positioned in such a way that one side of the grate faces toward and the other side of the grate faces away from the opening when the grate is moved to its inoperative position. This means that the one side of the grate is accessible via such opening in the housing and the other side of the grate is accessible from the exterior of the housing or by way of a second opening. The rows of teeth are located at the general level of the opening in the housing when the grate is caused or allowed to assume its inoperative position; this enables the attendants to clean the grate (e.g., by knocking out material which is jammed between the neighboring rows of teeth) by treating the grate with appropriate tools which reach the grate through the opening in the housing.

The grate further comprises a frame preferably including two spaced-apart parallel plate-like cheeks and several crossbeams extending between and connecting the cheeks to each other. The rows of teeth are disposed intermediate the two cheeks and are carried or otherwise supported by the crossbeams. The frame can comprise more than two cheeks; the additional cheek or cheeks are then disposed between the two first mentioned cheeks and are connected with the crossbeams to enhance the stability of the frame. At least one of the cheeks is secured to the mounting means, and the crossbeams of the frame are preferably at least substantially parallel to the pivot axis of the grate. The rows of teeth are preferably disposed in vertical planes; to this end, the grate preferably comprises a discrete plate-like carrier for each row of teeth, and each such carrier is preferably disposed in a vertical plane which is normal to the pivot axis of the grate.

The machine further comprises means for releasably holding the grate in the operative position, and such holding means can comprise a pair of shafts which support the cheeks of the frame in the operative position of the grate and extend from the respective sidewalls of the housing, a pair of reinforcing means each of which is externally adjacent to the respective sidewall, and a pair of bearing sleeves each of which connects a pair of reinforcing means to the respective sidewall and surrounds the respective shaft. Furthermore, the holding means can comprise manipulating means for moving the shafts axially in the respective bearing sleeves, namely, for engaging the shafts with or for disengaging the shafts from the respective sidewalls.

Portions of the aforementioned carriers can be inserted into and removably held in suitable sockets which are provided in the crossbeams of the frame. Each carrier can support or can be made integral with a series of several (e.g., two) teeth. The carriers can be provided with lateral projections, and the projections of the neighboring carriers are preferably in contact with each other to reinforce the frame of the grate.

The machine preferably further comprises means for moving the grate between its operative and inoperative positions. Such moving means can comprise a pair of fluid-operated motors each of which is installed in the region of one of the aforementioned sidewalls and each of which is operatively connected with the grate.

Still further, the improved machine can comprise a second rotor which is rotatable in the housing about a second substantially horizontal axis and has axially staggered circumferentially extending annuli of external teeth. The two rotors define a nip and rotate in opposite directions so that their teeth move from above toward, through and beyond the nip, and each of the two rotors overlies the grate when the latter is held in its operative position. The annuli of teeth on the one rotor are staggered with reference to the annuli of teeth on the second rotor, as considered in the axial direction of the two rotors. If the machine comprises two rotors, the grate preferably comprises a discrete second set of several rows of teeth, and such rows of teeth are disposed between the annuli of teeth on the second rotor when the grate is moved to its operative position. The rows of teeth which form one of the sets are staggered with reference to the rows of teeth forming the other set, as considered in the axial direction of the rotors and in the direction of the pivot axis. The arrangement is preferably such that the rows of teeth which form one of the sets are supported by the median crossbeam and one outer crossbeam of the frame, and the rows of teeth of the other set are supported by the median crossbeam and the other outer crossbeam.

The novel features which are considered as characteristic of the invention are set forth in particular in the appended claims. The improved comminuting machine itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
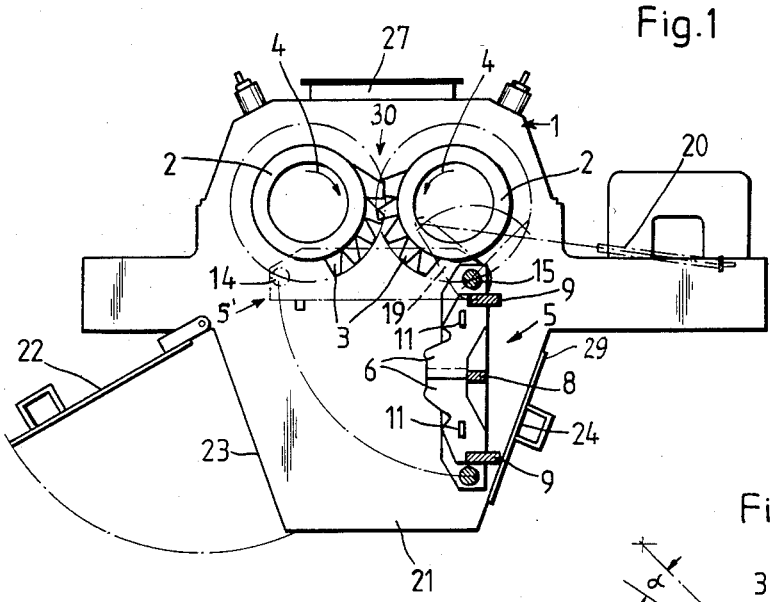
FIG. 1 is a schematic side elevational view of a twin-rotor roll crusher which embodies the invention, one sidewall of the housing being omitted and the operative position of the grate being shown by phantom lines.

FIG. 1 shows a comminuting machine which constitutes a roll crusher with two parallel rotors 2 mounted in a housing 1 for rotation about parallel horizontal axes. Each of the two rotors 2 is provided with several axially staggered circumferentially extending annuli of teeth 3, and each such annulus is disposed in a discrete plane which is normal to the axis of the respective rotor. The annuli of teeth 3 on one of the rotors 2 are staggered with reference to the annuli of teeth 3 on the other rotor 2, as considered in the axial direction of the rotors. The rotors 2 are driven to rotate in the directions indicated by arrows 4, i.e., in opposite directions and in such a way that successive teeth on the left-hand and right-hand rotors of FIG. 1 advance downwardly toward, through and beyond the nip 30 of the two rotors.

The roll crusher further comprises a grate 5 having two sets of rows of teeth 6, and mounting means including stub shafts 15 which serve to secure the grate 5 in the housing 1 for movement about a horizontal pivot axis which is parallel to the axes of the rotors 2 and is located at a level below the right-hand rotor, as viewed in FIG. 1. The operative position of the grate 5 is shown by phantom lines, as at 5'. When the grate 5 assumes such operative position, the rows of teeth 6 of one of the two sets extend from below between the annuli of teeth 3 on the right-hand rotor 2, and the rows of teeth 6 of the other set extend between the annuli of teeth 3 on the left-hand rotor 2. To this end, the rows of teeth 6 in one of the two sets are staggered with reference to the rows of teeth 6 in the other set, as considered in the axial direction of the rotors 2 and shafts 15. FIG. 1 shows that, when the grate 5 assumes the operative position 5', its rows of teeth 6 also extend between the two rotors 2 and toward the nip 30. In the illustrated embodiment, the grate 5 can partially surround each of the two rotors 2 along an arc of somewhat less than 90°. Each row of teeth 6 comprises only two teeth but the number of teeth in each row, or in some of the rows, can be increased to three or more.

Figure 2:
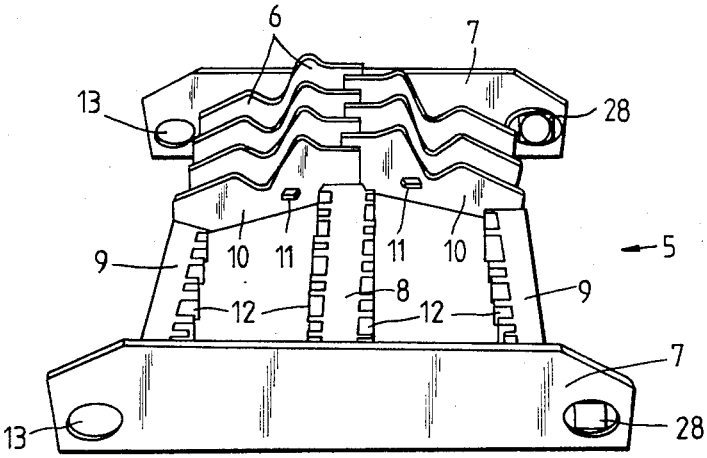
FIG. 2 is an enlarged perspective view of the grate, with several carriers for rows of teeth removed from the frame.

As can be seen in FIG. 2, the frame of the grate 5 comprises two spaced parallel cheeks 7 which are connected to each other by three crossbeams including a centrally located or median crossbeam 8 and two outer crossbeams 9. These crossbeams are at least substantially parallel to the pivot axis of the grate 5. The grate 5 further comprises two sets of substantially plate-like carriers 10 which are disposed in vertical planes extending at right angles to the pivot axis of the grate. Each such carrier 10 is provided with a series of two or more coplanar teeth 6. The right-hand set of carriers 10, as viewed in FIG. 2, is supported by the median crossbeam 8 and the right-hand crossbeam 9, and the left-hand set of carriers 10 is supported by the median crossbeam 9 and the left-hand crossbeam 9. The crossbeams 8 and 9 are formed with rows of sockets in the form of grooves or notches 12 which can removably receive portions of the respective carriers 10. Each of the carriers 10 is preferably provided with one or more lateral projections 11 which contact the projections 11 of the neighboring carriers or are in direct contact with the neighboring carriers. Such construction of the carriers 10 contributes to rigidity of the frame which includes the cheeks 7 and the crossbeams 8 and 9.

Figure 4:
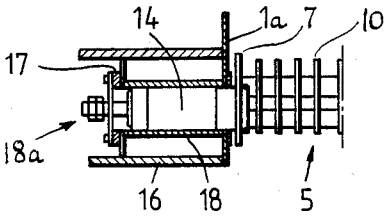
FIG. 4 is an enlarged fragmentary transverse sectional view showing a portion of mounting means for the grate.

The end portions of each of the cheeks 7 are provided with holes 13 and 28. The holes 28 have a polygonal (e.g., square or rectangular) outline and receive portions of stub shafts 15 forming part of the mounting means for the grate 5, and the holes 13 receive shafts 14 forming part of a means which serves to releasably hold the grate in the operative position 5'. The shafts 14 can constitute simple cylindrical pins which are axially movably mounted in the respective sidewalls **1*a* of the housing 1 (such sidewalls are disposed at the opposite axial ends of the rotors 2 and one thereof is shown in FIG. 4). Each sidewall 1*a* is provided with two externally located reinforcing members 16 and 17 which can be seen in FIG. 4 and which are connected to the respective sidewall 1*a* by a bearing sleeve 18 surrounding the respective shaft 14. The reference character 18*a* denotes in FIG. 4 a manipulating device which enables an attendant to extract the right-hand end portion of the respective shaft 14 from the corresponding hole 13 so that the grate 5** can be pivoted to its inoperative position.

The inner end portions of the stub shafts 15 are polygonal so that they can non-rotatably extend into the holes 28 of the respective cheeks 7. Such polygonal portions of the stub shafts 15 further extend through circular holes in the respective sidewalls **1*a* and through polygonal holes in levers 19 (see FIG. 1) forming part of means for moving the grate 5 between its operative and inoperative positions. Instead of having polygonal holes for the respective stub shafts 15, the levers 19 can be clampingly secured to the respective stub shafts or they may be secured to such stub shafts by resorting to suitable tongue-and-groove connections. The moving means of the illustrated roll crusher further comprises two fluid-operated motors 20 each of which is outwardly adjacent to the respective sidewall 1*a* and each of which can constitute a hydraulic cylinder and piston unit whose piston rod is connected to the corresponding lever 19 and whose cylinder is pivotally mounted on the respective sidewall 1*a*. The gate 5 can descend to its inoperative position by gravity, i.e., the motors 20** can be designed to merely lift the grate to its operative position.

When the motors 20 are actuated to move the grate 5 to the inoperative position which is shown in FIG. 1 by solid lines, the rows of teeth 6 extend substantially vertically downwardly from and are located at a level below the pivot axis defined by the stub shafts 15 of the mounting means for the grate below the right-hand rotor 2 of FIG. 1. In such inoperative position, one side of the grate 5 faces an opening 23 which is provided in the funnel-shaped lower portion 21 of the housing 1 and can be closed by a pivotable door 22 or by other suitable means (e.g., a slidable gate) for selectively exposing and closing the opening 23. An attendant who wishes to remove fragments of processed material from the spaces between the carriers 10 of the grate 5 can gain access to such carriers through the opening 23 or through a second opening 24 which is provided in the lower portion 21 of the housing 1 opposite the opening 23 and is immediately adjacent to the respective side of the grate 5 when the latter assumes its inoperative position. The opening 24 can be closed by a door 29 or the like. The material which is comminuted by the teeth 3 of the rotors 2 in cooperation with the teeth 6 of the grate 5, when the latter is held in the operative position 5' and the rotors are driven by suitable prime mover means (not shown), can leave the housing 1 through an outlet in the lowermost part of the housing portion 21.

Figure 3:
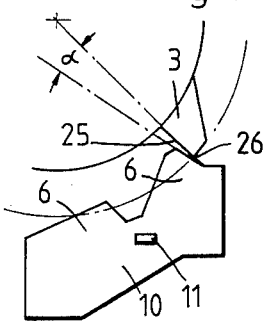
FIG. 3 is a schematic representation of the manner in which the teeth of the grate cooperate with the teeth of one of the rotors.

FIG. 3 shows that the front flanks 25 of teeth 3 on the rotors 2 and the front flanks 26 of teeth 6 on the carriers 10 of the grate 5 are positioned with reference to each other in such a way that, when the rotors 2 are driven, the front flanks 25 and 26 cooperate to produce a shearing action. The gap which is defined by cooperating flanks 25, 26 of the teeth 3 and 6 (note the angle alpha in FIG. 3) opens toward the axis of the respective rotor 2, i.e., the comminuting or shearing action proceeds toward the center of the rotor. The material which is to be comminuted by the rotors 2 in cooperation with the grate 5 is admitted into the housing 1 via inlet 27 at a level above the nip 30. The housing 1 can be permanently or removably installed on a stationary support or on a wheel-mounted or other conveyance, not specifically shown.

An important advantage of the improved machine is that both sides of the grate 5 are readily accessible as soon as the grate is pivoted (or allowed to pivot) to the inoperative position. This is attributable to the feature that the mounting means including the stub shafts 15 which define the pivot axis for the grate 5 is located below one of the rotors 2 and also to the feature that the grate 5 is pivotable to an inoperative position in which its carriers 10 extend substantially vertically downwardly from and hence below the pivot axis. Therefore, each of the two sides of the grate 5 is readily or fully accessible as soon as the grate assumes its inoperative position and as soon as the attendant or attendants open the doors 22 and 29. Since the carriers 10 are preferably merely inserted into the corresponding sockets 12 of the crossbeams 8 and 9, they can be readily cleaned or removed via opening 23 as soon as the grate 5 assumes its inoperative position. The grate 5 can hang in the inoperative position by gravity; however, if necessary, the grate can be locked in such position by the motors 20 or in another suitable way so as to allow for knocking out of hard-to-expel fragments of metal or other parts which happen to be caught between certain neighboring carriers. The dimensions of the opening 23 are preferably selected in such a way that all of the teeth 6 on each of the two sets of carriers 10 forming part of the grate 5 are readily accessible through such openings when the grate is pivoted to the inoperative position and the door 22 is opened.

The improved grate 5 and the mounting means therefor can be used with equal advantage in machines which employ a single rotor. In such machines, the dimensions of the grate can be reduced accordinly. For example, and referring to FIG. 2, the left-hand crossbeam 9 and the left-hand set of carriers 10 can be dispensed with if the housing 1 contains only the right-hand rotor 2 of FIG. 1. The cheeks 7 are then shortened accordingly, i.e., the means for releasably holding the grate in the operative position can be placed nearer to the pivot axis for the grate, and the opening 23 can be placed even closer to the respective side of the grate when the latter assumes its inoperative position.

Under certain circumstances, the improved grate and its mounting means can be installed also in so-called hammer breakers or hammer mills wherein the rotor is provided with one or more hammers which strike against the material to be comminuted in the spaces between the rows of teeth on the grate. It is immaterial whether such hammer mills employ a single rotor or several rotors.

The opening 23 and/or 24 must be provided only if the housing 1 of the improved machine extends well below the rotors 2 so that, in the absence of such opening or openings, the grate 5 would not be readily accessible on movement to its inoperative position. The provision of two openings in a funnel-shaped lower portion of the housing has been found to be particularly advantageous because this allows for expulsion of entrapped particles from either side of the grate, i.e., to the left or to the right, as viewed in FIG. 1 (while the grate is held in the inoperative position).

The aforedescribed grate 5 exhibits the important advantage that it is simple and inexpensive. Moreover, damaged carriers 10 can be replaced with little loss in time and the configuration of the carriers 10 (which may but need not necessarily be integral with the respective rows of teeth 6) can be readily selected in such a way that it follows the outlines of those portions of the rotors 2 which are surrounded by the grate when the latter is held in the operative position 5'. The provision of lateral projections 11 ensures that the grate 5 exhibits requisite stability even if the carriers 10 are relatively thin plates. Relatively thin carriers are desirable when they consist of a rather expensive material, e.g., when they must withstand the corrosive action of various acids which are contained in the goods to be comminuted during passage through the housing 1. In such instances, savings in the material of the expendable carriers contribute significantly to the economy of operation of the improved machine.

The aforedescribed mounting means exhibits the advantage that it allows for rapid and convenient removal or reinsertion of the grate 5 from and into the interior of the housing 1. Furthermore, and since such mounting means employs two relatively short shafts neither of which must extend well into the interior of the housing 1, it is possible to place the pivot axis for the grate 5 close to the axis of the respective rotor 2, i.e., such pivot axis can be located in the path of orbital movement of the annuli of teeth 3 on the right-hand rotor 2 of FIG. 1. This is desirable if the dimensions of the space below the rotors 2 are such that a relatively wide grate (e.g., a grate with two sets of carriers 10) would be incapable of assuming an inoperative position in a vertical or nearly vertical plane because those end portions of the cheeks 7 which are remote from the holes 28 would strike against the floor or against the ground before the carriers 10 would be free to extend vertically downwardly so as to afford most convenient access to their teeth 6 and to the spaces between such teeth. As explained above, the shafts 14 can be withdrawn by the manipulating means **18*a* so as to allow for pivoting of the grate 5 to its inoperative position. If the grate 5 is to be detached from the housing 1, the stub shafts 15 are removed from the respective sidewalls 1*a*; these shafts can be mounted in a manner which is similar to the manner of mounting of the shafts 14** of the means for releasably holding the grate in the operative position.

It has been found that the improved comminuting machine can be used with particular advantage for the breaking, crushing and/or similar treatment of discarded storage batteries for automotive vehicles or the like. This holds especially true if the housing 1 confines two rotors because the nip 30 between the two rotors is sufficiently wide to allow for entry of entire storage batteries which still contain acid and/or other aggressive substances. The rotors 2 are preferably driven in synchronism but in opposite directions so that their teeth 3 cause the batteries to penetrate deeper into the nip 30 and to be crushed and severed while the teeth 3 move downwardly toward, through and beyond the nip 30. This frees the acid which can escape by flowing through the spaces between the carriers 10 of the grate 5 and thereupon through and downwardly beyond the lower portion 21 of the housing 1. As the partially crushed and severed batteries advance beyond the nip 30, they are subjected to an additional intensive comminuting action during passage through the spaces between the carriers 10 of the grate 5 while the grate is held in the operative position 5'. The fragments which descend downwardly and beyond the grate 5 can be readily classified and/or otherwise treated in accordance with heretofore known techniques. Reference may be had to the commonly owned copending patent application Ser. No. 242,476 of Eberhard HUWALD et al. filed Mar. 11, 1981 for "Method of recovering lead and lead compounds from discarded lead storage batteries".

The advantages of the improved configuration and mounting of the grate 5 will be readily appreciated by bearing in mind that the housings of many storage batteries consist of polypropylene or analogous extremely tough substances. It has been found that fragments of such housings and battery parts which consist of lead and/or other metallic stock are highly likely to be caught in the grate of a machine wherein the storage batteries are broken up so that the accessibility of both sides of the grate 5 upon movement to the inoperative position is of considerable help in facilitating the removal of such fragments and metallic stock. If the fragments of polypropylene and/or pieces of metallic material are caught between the teeth 6 with such a force that they cannot be readily knocked out from the spaces between the carriers 10 while the grate is held in the inoperative position, the corresponding carrier or carriers 10 are simply removed from the frame of the grate to further simplify the task of attendants who are in charge of keeping the grate free of foreign particles. As explained above, the carriers 10 need not be positively secured to the frame; they can simply extend into the corresponding sockets 12 of the respective crossbeams 8, 9 between the cheeks 7. Complete removal of one or more carriers 10 from the frame of the grate 5 may be desirable if fragments of lead or the like are convoluted around the carriers so that they cannot be readily separated while the carriers are located within the confines of the lower portion 21 of the housing 1.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. A comminuting machine, particularly a roll crusher, comprising a housing; two rotors mounted in said housing for rotation about substantially horizontal axes and having axially staggered circumferentially extending annuli of external teeth, the annuli of external teeth of one of said rotors alternating with the annuli of external teeth of the other of said rotors in the axial direction of said rotors, said rotors defining a nip and being arranged to rotate in opposite directions so that their teeth move from above toward, through and downwardly beyond said nip; a substantially flat grate having two sets of teeth, the teeth of one of said sets alternating with said annuli of teeth of one of said rotors and the teeth of the other of said sets alternating with the annuli of teeth of the other of said rotors; and mounting means provided on said housing and defining for said grate a pivot axis located at a level below one of said rotors, said grate being turnable in its entirely about said pivot axis between an operative position in which said sets of teeth extend from below between the annuli of teeth of the neighboring rotors in the region from said nip to the undersides of both rotors and an inoperative position in which said grate extends vertically downwardly from said pivot axis.

2. The machine of claim 1, wherein each of said rows sets of teeth has an end portion adjacent said mounting means.

3. The machine of claim 1, wherein said pivot axis is at least substantially parallel to the horizontal axis of said one rotor.

4. The machine of claim 1, wherein said housing has an opening and means for selectively closing and exposing said opening, said grate having first and second sides respectively facing toward and away from said opening in the inoperative position of said grate.

5. The machine of claim 4, wherein said teeth are located at the general level of said opening in the inoperative position of said grate.

6. The machine of claim 1, wherein said grate further comprises a pair of spaced-apart cheeks and crossbeams extending between and connecting said cheeks to each other, said teeth being disposed intermediate said cheeks and being carried by said crossbeams.

7. The machine of claim 6, wherein at least one of said cheeks is secured to said mounting means and said crossbeams are at least substantially parallel to said pivot axis, said teeth being disposed in substantially vertical planes.

8. The machine of claim 6, further comprising means for releasably holding said grate in said operative position.

9. The machine of claim 8, wherein said holding means comprises a pair of shafts supporting said cheeks in the operative position of said grate and extending from said housing, reinforcing means externally adjacent to said housing, and bearing sleeves connecting said reinforcing means with said housing and surrounding said shafts.

10. The machine of claim 8, further comprising manipulating means for moving said shafts axially in the respective bearing sleeves.

11. The machine of claim 6, wherein each of said sets has several rows of teeth and said grate further comprises a discrete carrier for each of said rows of teeth, said crossbeams having sockets removably receiving portions of said carriers.

12. The machine of claim 1, wherein each of said sets has several rows of teeth and each of said rows of teeth comprises a series of several teeth.

13. The machine of claim 1, wherein each of said sets has several rows of teeth and said grate further comprises a carrier for each of said rows of teeth, said carriers having lateral projections contacting the neighboring carriers.

14. The machine of claim 1, further comprising means for moving said grate between said operative and inoperative positions.

15. The machine of claim 14, wherein said housing has a pair of sidewalls disposed at the opposite axial ends of said rotor and said moving means comprises fluid operated motors mounted in the regions of said sidewalls and connected with said grate.

16. The machine of claim 1, wherein the annuli of teeth on said one rotor are staggered with reference to the annuli of teeth on the other of said rotors, as considered in the axial direction of said one rotor.

17. A comminuting machine, particularly a roll crusher, comprising a housing; two rotors mounted insaid housing for rotation about substantially horizontal axes and having axially staggered circumferentially extending annuli of external teeth, said rotors defining a nip and being arranged to rotate in opposite directions so that their teeth move from above toward, through and downwardly beyond said nip; a grate having two sets of several rows of teeth each, the rows of teeth of each of said sets alternating with said annuli of a different one of said rotors, said grate further having a frame including a pair of spaced-apart cheeks and crossbeams extending between and connecting said cheeks to one another, said crossbeams including a mediam crossbeam and two outer crossbeams, the rows of teeth of one of said sets being supported by said mediam crossbeam and one of said outer crossbeams, beams, and the rows of teeth of the other of said sets being supported by said median crossbeam and the other of said outer crossbeams; and mounting means provided on said housing and defining for said grate a pivot axis located at a level below one of said rotors, said grate being movable about said pivot axis between an operative position in which said rows of teeth extend at least from below between the neighboring annuli of teeth and an inoperative position in which said rows of teeth are located beneath and extend downwardly from said pivot axis, each of said rotors overlying said grate when the latter assumes said operative position and the annuli of teeth on said one rotor being staggered with reference to the annuli of teeth on the other of said rotors, as considered in the axial direction of said one rotor.

* * * * *